US006252823B1

(12) United States Patent
McDonald et al.

(10) Patent No.: US 6,252,823 B1
(45) Date of Patent: Jun. 26, 2001

(54) RECORDER DEVICE, READING DEVICE AND REGULATING DEVICE

(75) Inventors: Andrew McDonald; Victor Leo Duffy; Alan Polkinghorne, all of Cumbria (GB)

(73) Assignee: Vu-Data Limited, Workington (GB)

( * ) Notice: Subject to any disclaimer, the term of this patent is extended or adjusted under 35 U.S.C. 154(b) by 0 days.

(21) Appl. No.: 08/849,815

(22) PCT Filed: Dec. 15, 1995

(86) PCT No.: PCT/GB95/02939

§ 371 Date: Jun. 16, 1997

§ 102(e) Date: Jun. 16, 1997

(87) PCT Pub. No.: WO96/18977

PCT Pub. Date: Jun. 20, 1996

(30) Foreign Application Priority Data

Dec. 16, 1994 (GB) ..... 9425469
Dec. 16, 1994 (GB) ..... 9425470

(51) Int. Cl.[7] ..... G04F 1/00

(52) U.S. Cl. ..... 368/9; 368/8

(58) Field of Search ..... 368/1, 8, 9, 107–113

(56) References Cited

U.S. PATENT DOCUMENTS

| | | | |
|---|---|---|---|
| 3,777,266 | | 12/1973 | Marwell et al. . |
| 3,911,362 | | 10/1975 | Roberts et al. . |
| 3,973,110 | | 8/1976 | Rode et al. . |
| 4,006,415 | | 2/1977 | Finger . |
| 4,049,952 | | 9/1977 | Forsslund . |
| 4,112,926 | | 9/1978 | Schulman et al. . |
| 4,135,246 | | 1/1979 | McMannis . |
| 4,142,238 | | 2/1979 | Brandt et al. . |
| 4,150,333 | | 4/1979 | Edwards et al. . |
| 4,238,832 | | 12/1980 | Tsuzuki et al. . |
| 4,280,185 | | 7/1981 | Martin . |
| 4,361,877 | * | 11/1982 | Dyer et al. ..... 368/9 |
| 4,366,373 | | 12/1982 | Metcalf . |
| 4,396,293 | | 8/1983 | Mizoguchi . |

(List continued on next page.)

FOREIGN PATENT DOCUMENTS

| | | | | |
|---|---|---|---|---|
| 2922798 | * | 12/1980 | (DE) | 368/9 |
| 0 289 136 | | 11/1988 | (EP) | G06K/7/08 |
| 1 604 498 | | 12/1981 | (GB) | G07C/3/04 |
| 2 142 172 | | 12/1986 | (GB) | G04F/10/04 |
| 2 230 340 | | 10/1990 | (GB) | G04F/10/04 |
| 2 277 175 | | 10/1994 | (GB) | G04G/15/00 |
| 2 002 120 | | 2/1997 | (GB) | G07C/3/04 |
| WO 90/06555 | | 6/1990 | (WO) | G06F/11/00 |

*Primary Examiner*—Bernard Roskoski
(74) *Attorney, Agent, or Firm*—Harold L. Marquis

(57) ABSTRACT

A run time recorder device (1,10) monitors the operating time of an electrical appliance driven by AC. The device is coupled to the supply voltage and monitors the supply by determining the operating time of the appliance from the number of repetitions of the periodic wave form of the supply voltage. A reading device for use with the recorder device may be coupled to the recorder device either by the supply leads or via a contactless coupling for the transmission and reception of signals to and from the recorder device. A regulating device (200) for regulating a load apparatus (144) comprises a controller (110), a memory (116) for storing an instruction data set means (118) for monitoring a condition such as temperature which is used by the controller to determine when to change the operating state and an interface (120) for communicating with the load apparatus. The controller compares a signal from the monitoring means with data stored in the memory to determine when to change the operating state of the load apparatus and has an input means (114) enabling an instructional data set to be input to the controller so as to be stored in the memory. The input comprises an infra-red detector enabling the data set to be input by a non-tactile method.

30 Claims, 14 Drawing Sheets

U.S. PATENT DOCUMENTS

| | | | | |
|---|---|---|---|---|
| 4,547,891 | | 10/1985 | Avellino et al. . | |
| 4,652,139 | * | 3/1987 | Sulcer, Jr. | 368/9 |
| 4,712,195 | | 12/1987 | Finger . | |
| 4,733,361 | | 3/1988 | Krieser et al. . | |
| 4,822,997 | | 4/1989 | Fuller et al. . | |
| 4,920,549 | * | 4/1990 | Dinovo | 368/9 |
| 5,050,113 | | 9/1991 | Podkowa et al. . | |

* cited by examiner

RECORDER DEVICE, READING DEVICE AND REGULATING DEVICE

The invention relates to a recorder device for monitoring the operating, or running, time of an electrical system such as a power tool, washing machine, cooker or other appliance for example. The invention also relates to a reading device for reading data from such a timing device, or run time recorder, which reading device might also provide power to drive microcomputer devices. The invention also relates to a regulating device for regulating the operation of equipment such as heating devices such as panel heaters for offices.

It is known from GB 1572342 to provide a run time recorder comprising an oscillator and divider which are functional only when the power supply to the electrical system being monitored is on. The oscillator and divider provide a periodic signal to a counter which increments a record of the total run time of the monitored appliance which is continually read into a non-volatile memory store. The run time information is also displayed continuously on a display clock when the supply voltage is present. Such a system is relatively expensive to manufacture since a display can be relatively costly and requires additional components and power in order to be driven correctly. An additional disadvantage is that the system requires the non-volatile memory to be continually erased and updated in order to retain reasonably accurately the record of the elapsed operational time of the monitored system or appliance.

EP 0241648 discloses a more sophisticated electronic elapsed time meter which is connected across the electrical input supply to an appliance from which it also draws power in order itself to operate. The device comprises a microcomputer which communicates with a memory and a display such that both are constantly updated with data representative of the run time of the monitored appliance. Additionally, the device can comprise a capacitor connected to an input regulator which maintains power to the device for a short period after removal of the power supply to the appliance thereby to enable the microcomputer to update a non-volatile memory with the latest run time recordal data.

The devices according to the prior art require complex electronic circuitry having relatively large numbers of components such as visual output displays for displaying elapsed run time. Such run time recorders are relatively expensive to manufacture and draw excessive power from the power supply to the monitored appliance. Additionally, the known devices constantly update their non-volatile memory and since such memory devices allow only a finite number of erase/write operations to given memory addresses and accordingly errors in the stored data will arise after a finite period of operation of the appliance. Additionally, EP 0241648 requires a voltage detector to generate a signal indicative of cessation of an input voltage to the monitored appliance. Such a detector can be susceptible to erroneously indicating that the supply voltage has been turned off when in fact only a minor temporal variation in the supply voltage has occurred.

A device for reading an RTR device is known from U.S. Pat. No. 4,852,104 which discloses a reader device comprising a specialised pulse power source included in a custom solid state chip which pulse power is transmitted to a transducer in a run time recorder and means for acquiring data from the recorder and for displaying said data. The system further comprises means for providing power to both the reader device and the run time recorder. In particular, the system comprises means for providing plural checks and for indicating faults in the combined system of the reader and recorder thereby to enable accuracy and reliability in the reading of data from the recorder.

The invention seeks to avoid or at least mitigate the various problems of the known art. According to one aspect of the invention there is provided a device for monitoring the operating time of an electrical appliance operably driven by a periodically repeating variable supply voltage, wherein the device comprises means for coupling to the supply voltage and for communicating a signal representative of the periodically repeating wave form of the supply voltage to means for monitoring said supply signal which monitoring means operably determines the operating time of the appliance from the number of repetitions of said periodic wave form.

Another aspect provides a device for monitoring the operating time of electrical appliance operably driven by an input voltage wherein the device comprises means for coupling to said input voltage and communicating a signal representative of the nature of said input voltage to monitoring means which operably determines the nature of said input voltage and communicates a signal indicative thereof to a controller which is thereby able to determine a mode of operation of the device.

A further aspect of the invention provides a device for monitoring the operating time of an electrical appliance operably driven by a periodically repeating variable supply voltage, wherein the device comprises means for coupling to the supply voltage and for communicating a signal representative of the periodically repeating wave form of the supply voltage to means for monitoring said signal which monitoring means operably determines when the supply voltage is terminated due to the absence of a repeating wave form.

Another aspect provides a device for monitoring the operation run time of an electrical system operably driven by an AC supply wherein the device comprises means for coupling to the AC supply thereby to communicate a signal representative of the periodically repeating wave form of the supply to means for monitoring the supply which enables determination of the removal of said AC supply in the absence of a periodically repeating wave form.

A yet further aspect provides a device for communicating with a run time recorder which comprises means to transfer power to said recorder and wherein the voltage of said output power is modulated thereby to communicate with the recorder.

Another aspect of the invention addresses the problems experienced when powering up microcomputers from very low current power supplies, such as may be found in mains powered devices employing resistive droppers, or solar cell powered devices. Typical problems experienced are: slow rise of power supply voltage leading to power on reset timers timing Out before correct operating voltage has been reached; reset being released before guaranteed operating voltage reached; load current rising well above normal operating levels, as a result of CMOS input current spike which can be sufficient to prevent power supply establishing itself; and microcomputers which draw excess current when reset. Most of these problems are encountered in the design of a RTR. Accordingly an aspect of the invention provides a snap action power supply such as an electrical device for controlling the voltage applied to a microcomputer which device comprises means for delaying application of a supply voltage to power the microcomputer being applied thereto until it has reached a predetermined magnitude.

Another aspect of the present invention relates to regulating devices. It is known to provide sophisticated regulators for heating systems for example, which comprise complex electronic control circuitry containing a non-volatile memory for storing instructional data for the programmed operation of the device. Such known regulator devices can comprise sophisticated user interfaces having one or more displays and buttons which enable the user to input certain control requirements into the device. The control requirements are implemented by the pre-programmed regulator thereby to regulate the operation of the requisite equipment such as a heating system for example. Such regulators are readily adjusted at said user interfaces, for example to adjust the thermostatically controlled temperature of a room and/or the timed operation thereof. This can be a disadvantage in situations where a regulator is required to be controlled by one person only and not just anybody. However, a disadvantage of this type of system is that it is expensive to manufacture since it requires relatively expensive components such as non-volatile memory, displays such as liquid crystal displays, and a plurality of user interface devices such as buttons. Of course regulators are used for devices other than heating systems such as to control access into a room or cabinet for example on a timed basis, to regulate flow in a process, and to monitor and control energy storage or emission for example, and similar problems can exist with these devices.

The invention seeks to avoid or at least mitigate the problems of the prior art and for example seeks to provide a relatively inexpensive regulator device and/or a regulator which is not easily tampered with but which is adjustable. According to one aspect of the invention, there is provided a device for regulating at least one operating state of an apparatus, comprising a controller, a memory for storing an instructional data set, an input means which enables an instructional data set for driving said controller to be stored in said memory, a means for monitoring a condition which condition is operably used by said controller to determine when to change said operating state of said apparatus, said monitoring means operably communicating a signal representative of said condition to said controller, and an interface for communicating with said apparatus, wherein said controller operably compares said signal from said monitoring means with data stored in said memory to determine when to change the operating state of said apparatus which change is operably effected via said interface.

Preferably said memory is volatile and termination of power to said volatile memory requires a further instructional data set to be entered via said input means in order for the device to be operable.

Preferably said input means comprises a detector which operably receives said instructional data set by a non-tactile method and preferably said detector is responsive to electromagnetic radiation; said detector can be an infra-red detector such as a solid state diode. Also, said detector can be housed in a housing which minimises the amount of ambient electromagnetic radiation and preferably visible radiation reaching the detector.

The monitoring means can comprise a clock, which preferably can be calibrated by inputting a reference via said input means. Said monitoring means can comprise a temperature sensor which preferably monitors the ambient temperature about said apparatus. Preferably said monitoring means can comprise a flow meter and/or a weighing device and/or energy measuring device. Also, the device can comprise an override device which allows a user to input a command to said device thereby to change the state of the apparatus preferably without changing said instructional data set. More preferably it comprises a back-up power source to maintain power to said volatile memory in the event of termination of power from the principal power source therefor. Said principal power source can be mains electricity and said back-up power source can be an energy storage device which operably stores electrical energy when said mains power source is being used by said device.

The device can comprise means for detecting termination of said mains power source thereby enabling said controller to minimise power consumption preferably by ceasing to control the state of operation of said apparatus and/or ceasing to control said monitoring means. Said interface can comprise memo for switching power to said apparatus on or off.

Another aspect of the invention provides use of a device to regulate the power to a heat source thereby to regulate the temperature of said heat source.

Embodiments of the invention will now be described, by way of example only, with reference to the accompanying drawings, in which.

Figure 1:
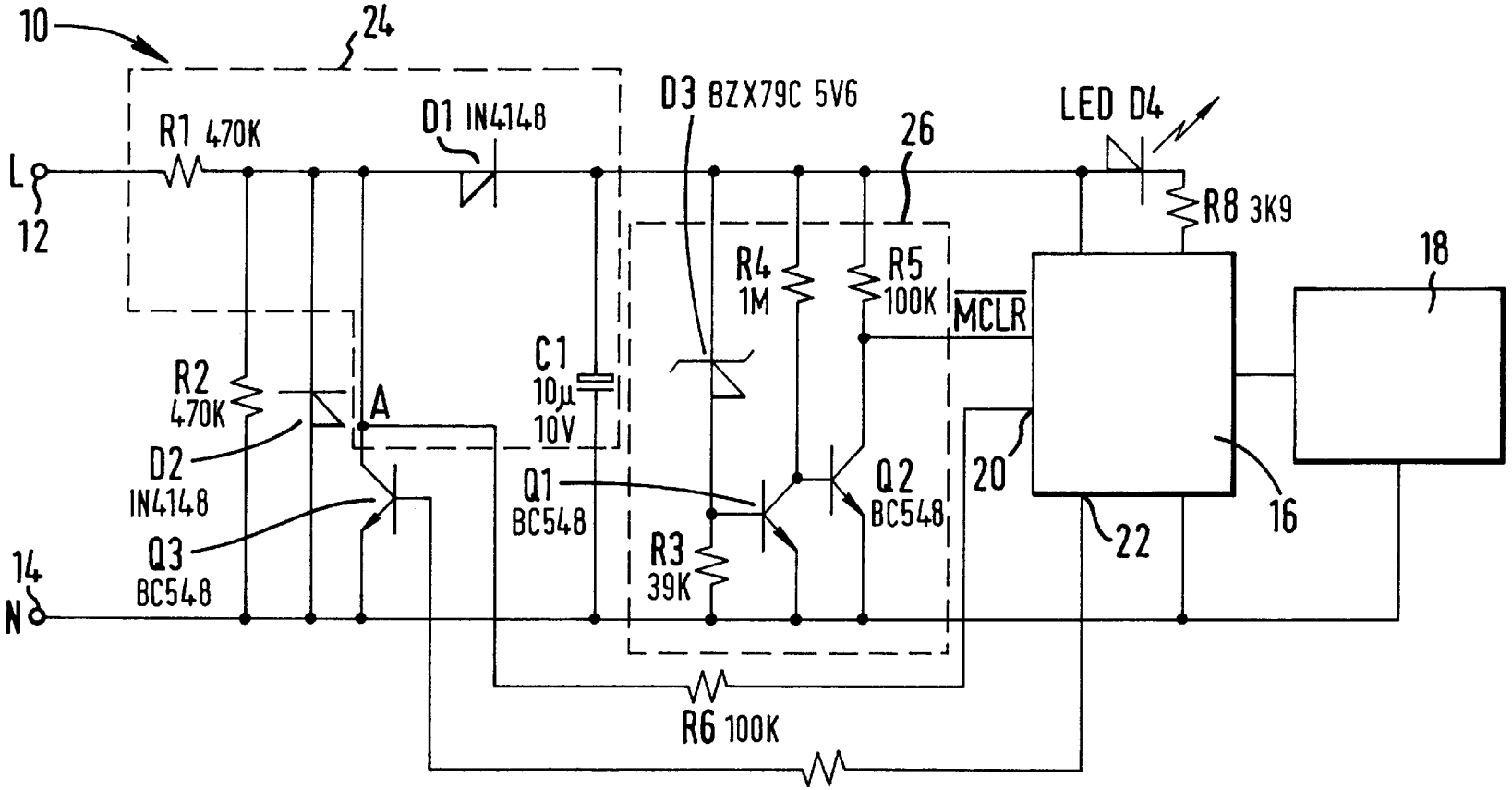
FIG. 1 is a schematic circuit diagram for a run time recorder according to the invention.

Referring to FIG. 1, there is shown an electrical circuit for a run time recorder 10 according to the invention which comprises a microcomputer 16, or other control system, which operably monitors the use of an appliance or other electrical system via inputs 12 and 14. In this example, device 10 is designed to monitor an AC supply such as a 50 Hertz 240 V supply to an electrical appliance and also to derive its own operating power from this supply.

The circuit shown in FIG. 1 comprises a half wave rectification circuit 24 which can consist of a resistor R1, of say 470 kOhms, diodes D1 and D2 which can for example be IN4148 type devices, and a capacitor C1 which might for example be an electrolytic capacitor of 10 micro-Farads (10 V). The output voltage from rectifier 24 is regulated by zener diode D3 which might be a BZX79C 5 V6 device, and by the B-E junction of transistor Q1 which might be a BC548 device, thereby to give a nominal output of 5.5 V which can be used to power up microcomputer 16.

Of course, all component types and the magnitude of their characteristic properties given in the description and all drawings are purely illustrative and the functional effects achieved can be effected through combinations of different components.

Resistor R1 acts to limit the supply input current to a level sufficient to power up and operate the circuit. The resistor can be a mains rated safety type in the range of 0.1 to 1.0 MOhms. The combined function of a power on reset circuit for the microcomputer and a shunt regulator for the power supply are provided by circuit elements labelled 26 comprising zener diode D3, resistors R3, R4 and R5 (which might be respectively 39 kOhms, 1 MOhms and 100 kOhms), and transistors Q1 and Q2 which might be of the type BC548.

When an appliance is turned on, the supply power therefore is seen across inputs 12 and 14 which causes an increase in the voltage across capacitor C1. Initially, transistor Q1 is non-conducting, hence Q2 is conducting and MCLR is held low, keeping the microcomputer 16 reset. When the voltage rises further, D3 begins to conduct and eventually enough voltage is developed across R3 to turn on Q1 and hence Q2 turns off and MLCR is released to go high allowing the microcomputer to run. This might occur for example at about 4 V if a 5.6 V zener diode D3 is used, but of course, the actual turn on value is adjustable by varying the magnitude of R3 and D3 for example.

As C1 charges still further, eventually the load current and the zener current will equal the input current and the voltage, which might for example be at 5.6 V, and will rise no further. Such a voltage is sufficiently above the reset voltage and the capacitance of C1 sufficiently great that when mains power is lost there is sufficient time for the microcomputer 16 to transfer data to the non-volatile memory 18 before the voltage across C1 drops too low.

Resistor R6 which might for example be 100 kOhms couples the supply voltage to microcomputer 16 at input port 20. This input signal can be used as a timing reference where the supply voltage to the monitored appliance has a periodic wave form as described later. Additionally, the same input can be used to input logic signals to the microcomputer when using a reader device to be described later. Resistance R2, which might be for example 470 kOhms, can provide a high resistance pull down to ensure that the input signal goes low when power is disconnected.

Run time recordal can be achieved by appropriately programming microcomputer 16. When the electrical system or appliance being monitored is turned on, and after release of MCLR as described above, tile microcomputer 16 can be held for a further delayed period, for example 90 milliseconds, to allow the power supply to become properly established. The microcomputer can then initialise its input/output ports and, possibly after a further delay of say another 90 milliseconds, RAM count registers (or volatile memory registers) which might form part of an integrated circuit within microcomputer 16. The volatile memory registers can be initialised by reading into them previously stored data from the non-volatile memory 18, which might be an EEPROM for example. The data could represent the accumulative run time and/or number of times of use of a monitored appliance for example.

The microcomputer 16 can be programmed to then test the input at pin 20 to determine which mode of operation it is required to adopt. For example, two modes can be provided in system 10, wherein the first is a run time recordal mode. This can be selected, for example, when an AC wave form is detected at pin 20 indicating that a supply voltage is applied across input pins 12 and 14 to the monitored appliance. A second mode can be a read out (and/or programming) mode wherein an operator can obtain information from the microcomputer such as, for example, the number of times the monitored appliance has been used and the total duration of such use; and/or write to the microcomputer 16 to reprogramme it for example. The latter read/programme mode might be determined by microcomputer 16 when it sees a large DC voltage at pin 20 for example. Of course, in embodiments where microcomputer 16 is used to monitor the run time of an appliance having a DC supply, the difference between the modes can be determined by different voltages at pin 20; the read Out mode for example being predetermined to be initiated by a greater voltage than the DC voltage used to drive the monitored appliance.

After establishing that device 10 is in a timing mode, an event counter data, having been read into the volatile memory for example, can be incremented by one and the input at pin 20 monitored to enable periodic updating of the run time data which might also be in the volatile memory. For example, the data stored in volatile memory can be incremented after each cycle of the AC supply, that is every 20 milliseconds for a 50 hertz supply. Naturally, other periods might be allowed to lapse before incrementing the volatile memory, however, by monitoring the input at pin 20 for example following AC to DC conversion, incrementation can conveniently take place at the leading edge of each positive going signal.

Beneficially therefore, the AC wave form of the supply voltage to the monitored appliance can be used by providing a time base for the run time measurement. Also, by monitoring the AC wave form, the system is able to relatively accurately (e.g. within 20 ms) determine when the supply is turned off and thus a separate detector for determining when this occurs is not required.

After converting the AC input at pin 20 to DC, the input signal can be digitally filtered to avoid counting spurious spikes or glitches on the supply wave form. Additionally, the frequency of the AC supply can be monitored by sampling the wave form and comparing it against a frequency standard within system 10. For example, it is possible to use a 32 kHZ crystal oscillator (not shown) which might also be used to provide a time base for a clock within microcomputer 16. Usefully, such a frequency monitoring system can be used to enable device 10 to be pre-programmed for use in either a 50 hertz or 60 hertz mains environment as provided for example in the UK and USA respectively. Naturally, the counts of the number of input cycles during a run time monitoring mode will need to be multiplied by the period of the actual AC cycle determined by such a frequency check system in order to determine the length of time of use of the monitored appliance.

When microcomputer 16 determines that the AC supply at input 20 is no longer present, it is, as already described, maintained in an operational mode due to C1 and at this time the microcomputer 16 can update the non-volatile memory by transferring the data held in the volatile memory which can be representative of the number of events, or time of use of the appliance and its total operating time for example. Beneficially, where a very accurate indication of the total run time of an appliance is required, a preset constant value can be added to the run time data each time the supply to the appliance is turned on which preset constant can represent the time taken between turning on the supply to the appliance and microcomputer 16 initiating incrementation of the volatile memory upon monitoring the input supply at pin 20; that is the delays due to initialisation for example.

If prior to loss of the requisite power to drive microcomputer 16 in the absence of a supply to the monitored appliance, the AC supply is re-established, the contents of the volatile memory can be checked to ensure that the data has not been lost and the microcomputer can go back to monitoring the input supply as if nothing had happened.

Optionally, the system can include a display such as LED D4 shown in FIG. 1. The LED can be illuminated when the counter has reached a predetermined time for example. Thus, the LED can be monitored by a service engineer in order easily to ascertain when the monitored apparatus needs to be serviced. Accordingly, an engineer could then interrogate the RTR to determine exactly how long the apparatus has been used, the previous service history of the apparatus and extinguish the LED thus resetting an extra counter for the service period for a further run time period to the next service. Naturally, the service history information could be input by a service engineer to be stored in non-volatile memory for example along with the service time interval which itself could be programmable using a reader/programmer device to be described. Additionally or alternatively, the LED could be used to indicate the end of a guarantee period thus informing a user of the need to renew a guarantee policy. Of course, upon renewal of the guarantee the preset time could be reset to allow for the extended policy.

Non-volatile memory such as EEPROMS have a finite lifetime determined by the number of erase/write cycles. In order to mitigate against errors due to re-use of the same memory address within the non-volatile memory, error correction and avoidance strategies can be used. For example, multiple redundant storage locations, particularly for the least significant digits of the stored data which change most often can be used. Additionally, the data might be stored in multiple locations and periodic comparisons of the data stored at the different locations made. Further error correction algorithms might be used. For example, errors due to memory faults can be detected and corrected in a number of ways, such as storing several (e.g. three or more) copies of critical data and comparing the stored data using a majority voting system. Any location deemed to be in error can be replaced by a new unused location. Also, a parity bit might be added to the data and two copies of the data kept. Thus, any data with a parity error could be replaced by equivalent data from the other set. Also, a forward error correction (FEC) code can be used such as Hamming to allow detection and correction of errors by replacing any data found to be corrupt.

Figure 2:
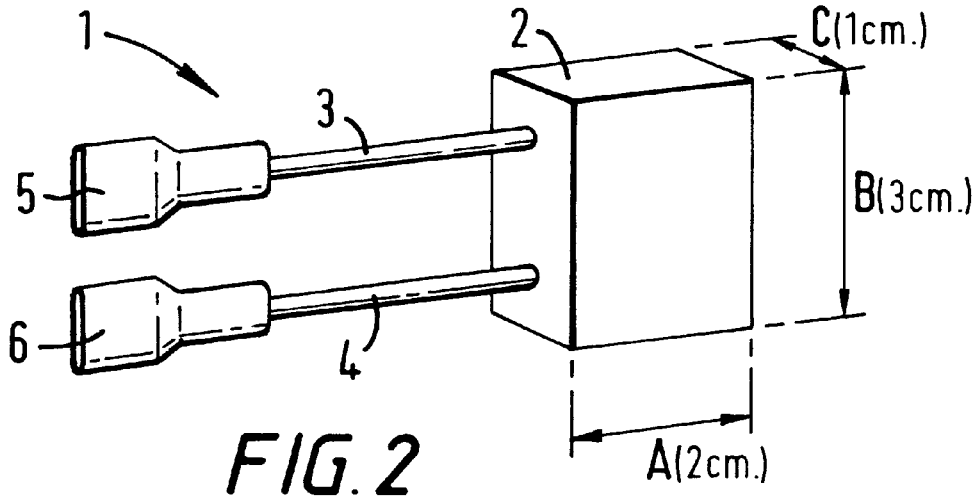
FIG. 2 is a schematic perspective view of a run time recorder according to the invention.

As shown in FIG. 2, a run time recorder, RTR, 1 according to the invention can comprise a sealed casing 2 for housing the electronic components which casing might for example having a width A of approximately 2 cm, a height B of approximately 3 cm and a depth C of approximately 1 cm. The inputs 12 and 14 as shown in FIG. 1 might be connected to leads 3 and 4 shown in FIG. 2 which in turn are connected to connectors 5 and 6 for connecting device 1 to an appliance. For example, connectors 5 and 6 might be 0.25 inch faston connectors.

Figure 4:
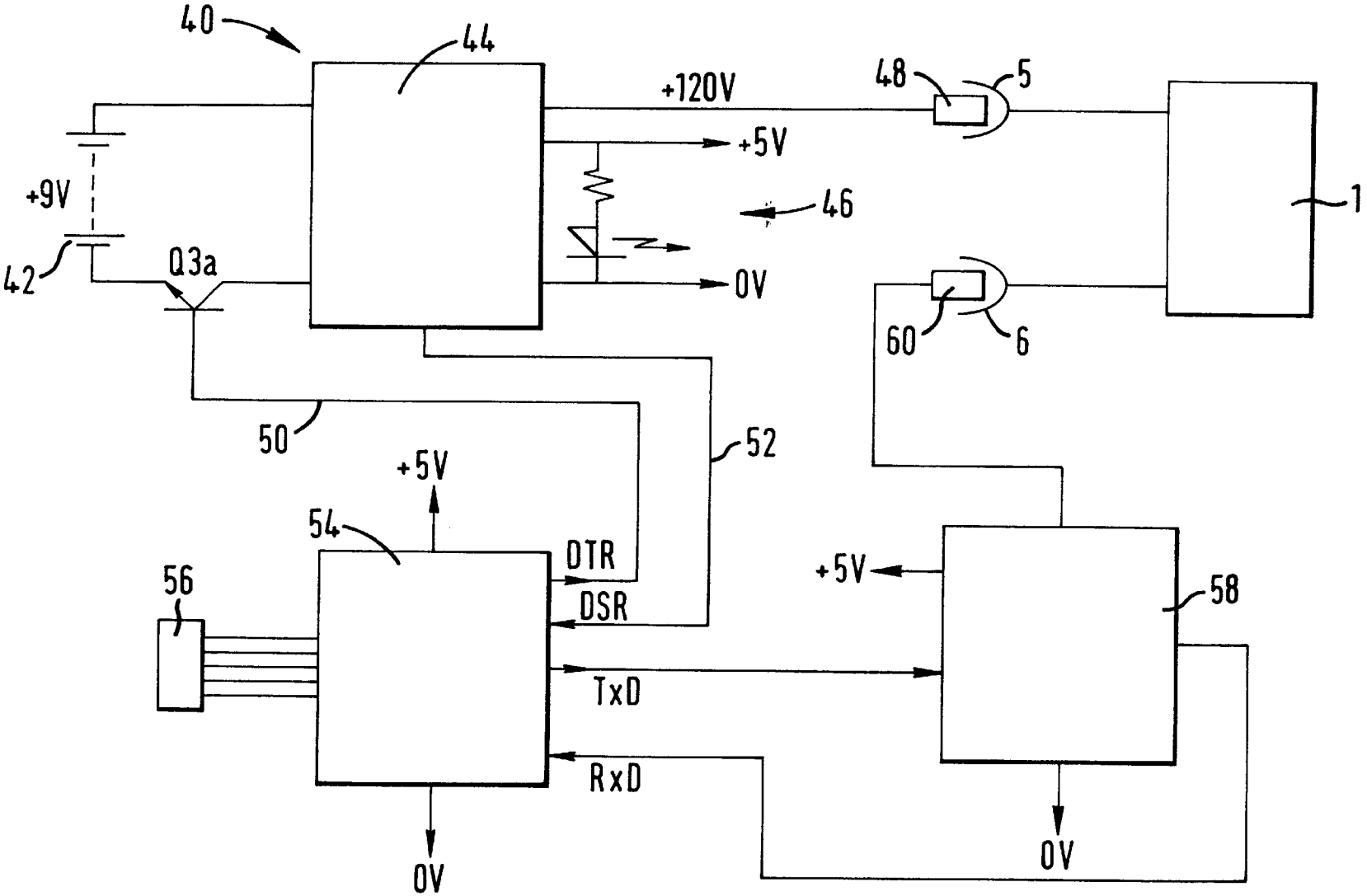
FIG. 4 is a schematic circuit diagram of a reader/programmer according to the invention.

In this example, when it is desired to read the data stored within non-volatile memory 18 for example on failure or breakdown of a monitored appliance such as a washing machine, RTR 1 can be disconnected and connectors 5 and 6 attached to a reader/programmer device such as reader 40 shown in FIG. 4.

The reader device might for example place a 120 V DC supply across inputs 12 and 14 of the system 10 shown in FIG. 1. In the read-out mode of the RTR, transistor Q3 provides the output path to the reader and shorts diode D2 and resistor R2 to output a logic zero. The voltage across R2 varies between Vf (D1), +Vf (D3), +Vbe (Q1), which might typically be between 6.3 V and 0 V. Thus, for a DC supply of a 120 V this variation driven by a microcomputer 16 via Output pin 22 results in a 5.5% change in the voltage across pins 12 and 14 (and/or current) which is sufficient to be detected by the reader 40 thus allowing transfer of data.

When the microcomputer 16 detects the requisite input signal to inform it that it is in a read mode, as opposed to a timing mode as described earlier, it can be programmed to monitor input 20 to look for an incoming command string which might for example begin with the character "=" in a given bit code. The characters of the command string can be received as a synchronous serial data at, for example, 300 bps with, again by way of example, one start, eight data, and one stop bit. The UAR/T function can be performed in software and the chosen data rate can be selected as the maximum that can reasonably be implemented using a 32 kiloHertz oscillator and microprocessor 16 which might be a PIC 16Cxx device. Of course, other microcomputers may be used and different data transfer mode and rates might be used. The incoming command string might be used to implement various operations of microcomputer 16 such as for example causing it to read out all data along the output at pin 22; programming microcomputer 16 such as causing it to store data, for example a 32 character string, in a non-volatile message memory; clearing any stored data or a portion thereof such as run time data or the event count data. As described earlier, the microcomputer can transmit its stored data to the reader via output 22 in the event of a read operation.

Figure 3:
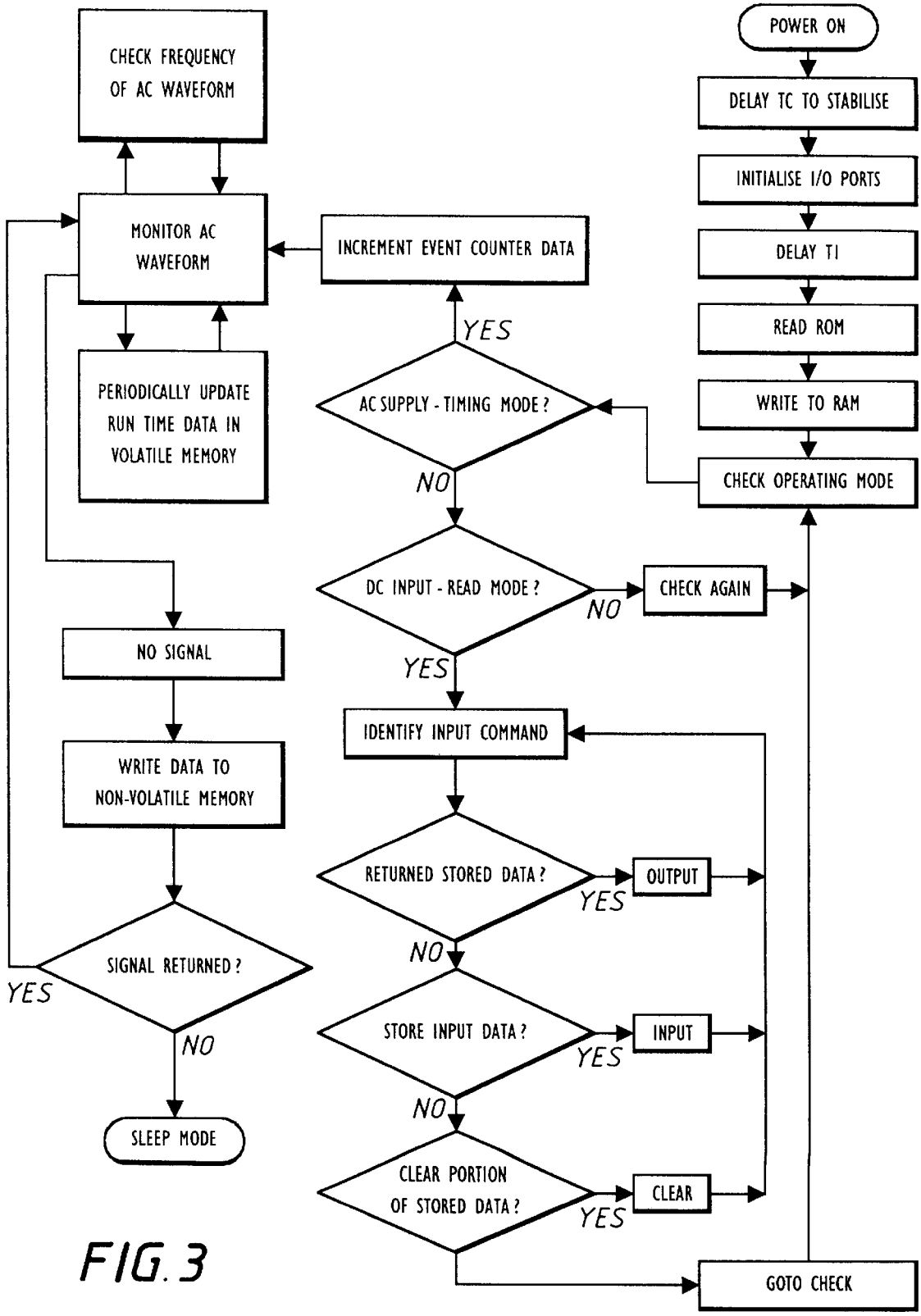
FIG. 3 is a schematic flow diagram of the operational steps in running a run time recorder according to the invention.

The above operations are shown schematically in a flow diagram shown in FIG. 3 which therefore describes a basic operation of a system according to the invention subject of course to all the variations described herein.

A device 40 for reading data from system 10 and/or writing thereto is shown in FIG. 4. The reader/programmer device 40 can comprise a DC power supply 42 such as a series of cells which generate a 9 V Output. This supply is operably connected across a step-up switching regulator and DC—DC converter 44 when switched on as in this example when Q3*a* is in a conducting mode. This operation is controlled by an interface device 54 which controls the operation of transistor Q3*a* via output DTR along power switch line 50. The regulator and DC—DC converter 44 generates a 120V DC output to connector 48 which operably can be connected to lead 5 of run time recorder 1. Additionally, a 5 V DC at output 46 is generated to provide a supply voltage to various components identified in FIGS. 4 and 5. A line 52 between regulator 44 and interface device 54 can be used to provide a signal indicative of the condition of the DC power supply 42. The interface device 54 comprises data transmission and data receiving lines (TXD and RXD respectively) which communicate with a buffer and adaptive data slicer 58 which operably can be connected via connector 60 and 6 to run time recorder 1. Communication between interface 54 and buffer 58 via TXD and/or RXD might use an asynchronous, non-return to zero technique at 300 bits per second. The reader-programmer device 40 can be driven by a computer connected via a serial port 56 such as an RS232 port to interface device 54. Alternatively, interface device 54 could itself be a microcomputer system which is preprogrammed to provide output data to interface 56 which might be connectable to a visual display for example.

Figure 5:
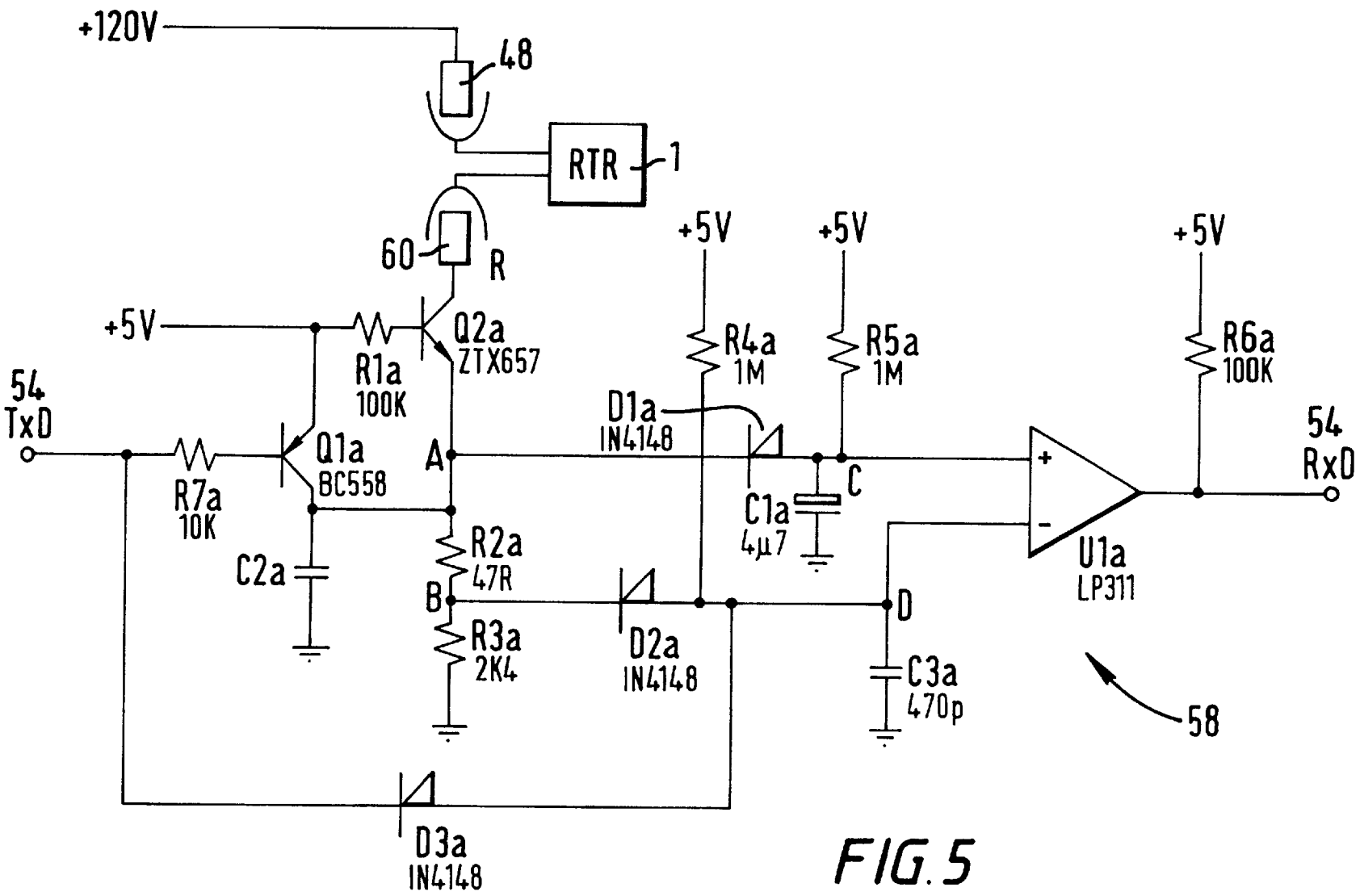
FIG. 5 is a schematic circuit diagram of the adaptive data slicer part of the circuit shown in FIG. 4.
Figure 6:
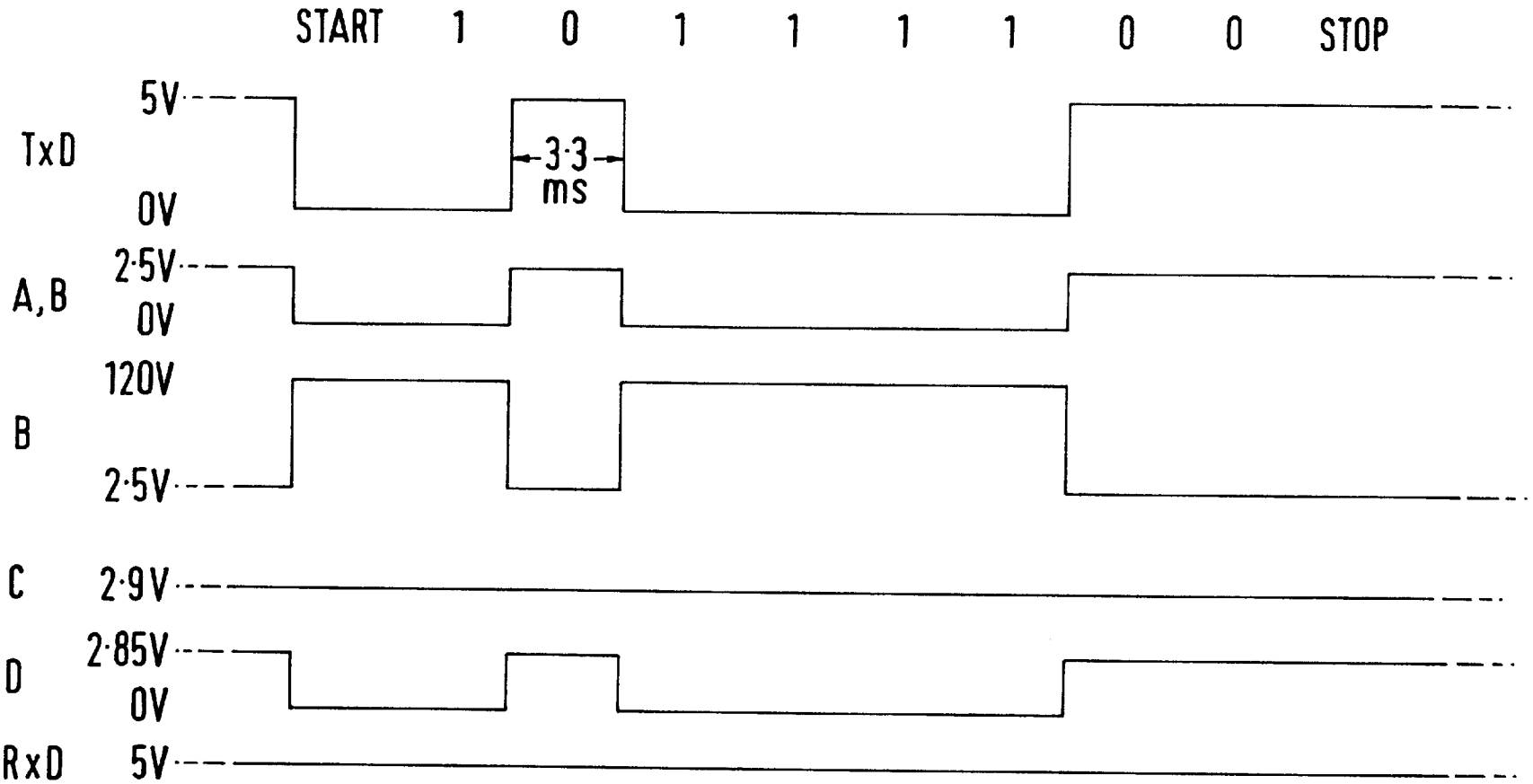
FIG. 6 is a pulse sequence diagram of the transmission mode of the reader/programmer shown in FIGS. 4 and 5.

In this example of a reader-programmer device, the transmission of a command to the n time recorder is achieved by retaining the idle state of TXD high (e.g. 5 V) so Q1*a* shown in FIG. 5 is non-conducting and D3*a* (which might be an IN4148 device) is reverse biased. Transistor Q2*a* (e.g. a ZTX657 device) is saturated with the full supply voltage appearing across the run time recorder 1. The value of resistors R2*a* and R3*a* can be chosen to drop approximately 2.5 V with the nominal RTR (run time recorder) supply current, and the value of R1*a* can be chosen so that enough base drive is available for transistor Q2*a* to just ensure saturation thereof. Thus, when TXD goes low to transmit a start bit (logic zero) to RTR as shown in FIG. 6, Q1*a* is turned on which pulls the emitter of Q2*a* to 5 V thus turning Q2*a* and the power supply to the RTR off. When TXD goes high to signal a logic 1, the reverse happens. Thus, for a pulse sequence shown in FIG. 6 at TXD, an output sequence as identified by the letter R in FIG. 6, is generated at connector 60.

RXD to device 54 should be held high so that spurious data is not received during this transmission mode. Diode D3*a* and capacitor C3*a* can ensure that point D shown in FIG. 5 is held low whenever TXD is low and for a brief period thereafter, thus masking transient effects which could appear on the Output to RXD of device 54.

As described earlier, after receipt of a command from such a reader device 40, the RTR may return data thereto. The RTR can modulate the data onto its supply current, for example, increasing the current by about say 4% to represent a logic 1 state.

Figure 7:
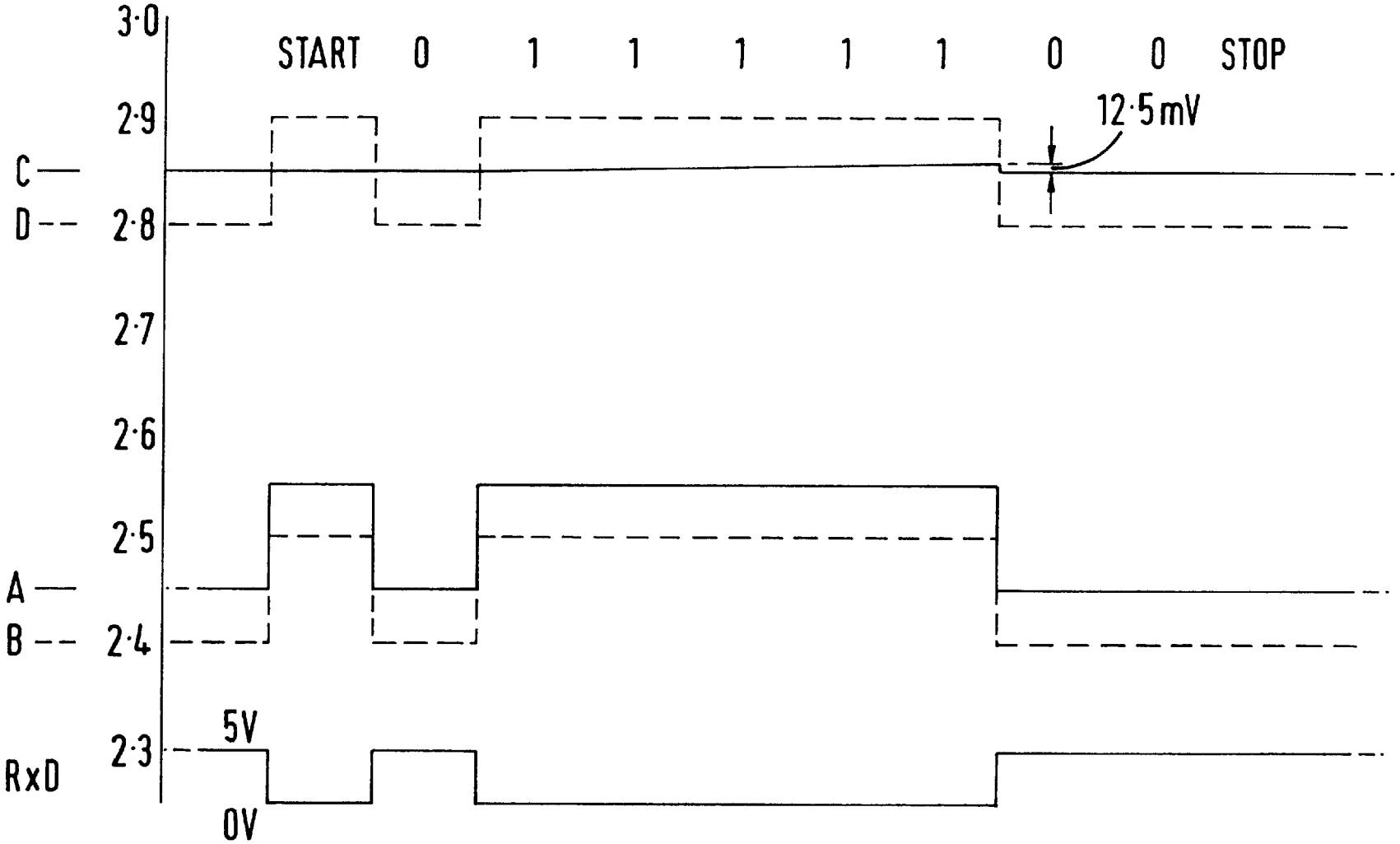
FIG. 7 is a pulse diagram of the reader/programmer shown in FIGS. 4 and 5 in a data reception mode.

FIG. 7 shows a pulse sequence diagram as it appears at various points in the circuit shown in FIG. 5 during a receipt node for data from a RTR. R3*a* can be chosen to drop about 2.4 V with the nominal RTR current draw of one mA. Resistor R2*a* can be chosen so that the voltage between points A and B in the circuit of FIG. 5 is about half the bit voltage change of 100 mV, i.e. 50 mV. The voltage at point A is offset by a voltage drop across diode D1*a* and the residual voltage is stored across capacitor C1*a* so that the voltage at point C is about 2.85 V in this example. Similarly, the voltage at point D is about 2.8 V, for example, and point C is thus 50 mV more positive than the voltage at point D so that the comparator U1 a (e.g. an LP311 device) has a high output. When the RTR generates a logic one output, the voltage at point B and hence point D increases, in this example, by about 100 mV to 2.9 V. However, the voltage at point C remains ostensibly at 2.85 V by virtue of capacitor C1*a*. The voltage at point D is now more positive than at point C so the output from comparator U1*a* goes low. The capacitance of C1*a* can be chosen so that the voltage at point C changes about a quarter of the bit voltage (25 mV) for the longest sequence of logic "one's" (9 off or 29.7 mS at 300 BPS).

The voltage at point C thus stays ostensibly constant during data transmission but will change slowly to compensate for variations in power supply voltages and RTR characteristics.

Capacitor C2*a* bypasses high frequency noise from the switching regulator 44 which might otherwise interfere with reception of the low level data from the RTR. In the event of a short circuit across the RTR connections, the current is limited to approximately twice the nominal RTR supply current by transistor Q2*a* which comes out of saturation and acts as a current source. An alternative design uses a high voltage opto-coupler to switch the positive supply connection to the RTR.

Of course, the types of devices stated against the individual components shown in the various figures and the values thereof are only given by way of example. Additionally, in this example a data transfer rate of 300 BPS is described and for example the width of each bit in the time sequence diagrams of FIGS. 6 and 7 is therefore 3.3 milliseconds whereas, of course, other data transfer rates and modes other than asynchronous transfer might be used.

Referring now to FIGS. 8, 9, 10 and 11, there is shown a modified form of run time recorder and reader device according to the invention and/or another inventive aspect thereof which uses non-contact coupling between the devices. The reader device 40 shown in FIG. 4 requires that the run time recorder such as RTR 1 shown in FIG. 2 is disconnected from its host appliance and reconnected to the reader. However, a modified RTR 1' can be used which comprises a pair of small antenna plates PA and PB shown in FIGS. 8 and 9 which can for example be electrically insulated in the casing of the RTR 1'. RTR 1' might be powered by turning on the power supply to the monitored appliance for example, via lines L and N shown in FIGS. 8 and 9. Thus RTR 1' can remain connected to an appliance whilst it is interrogated.

Figure 8:
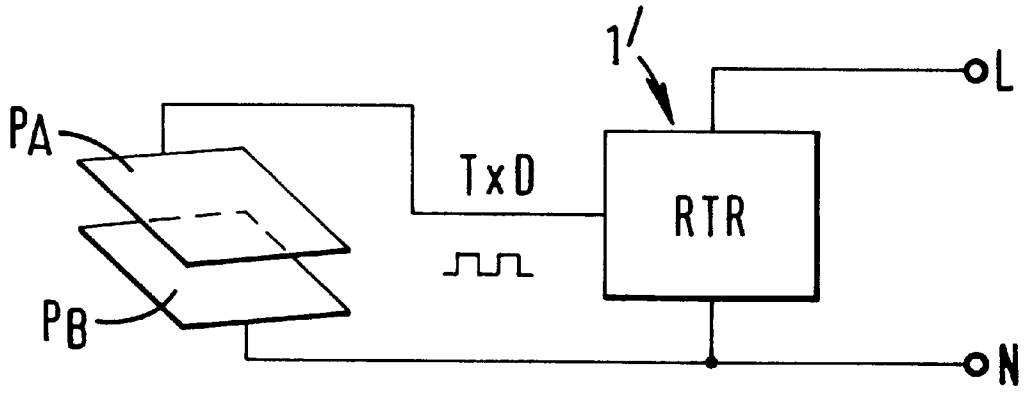
FIG. 8 is a schematic circuit diagram of a second embodiment of a run tine recorder according to the invention.
Figure 9:
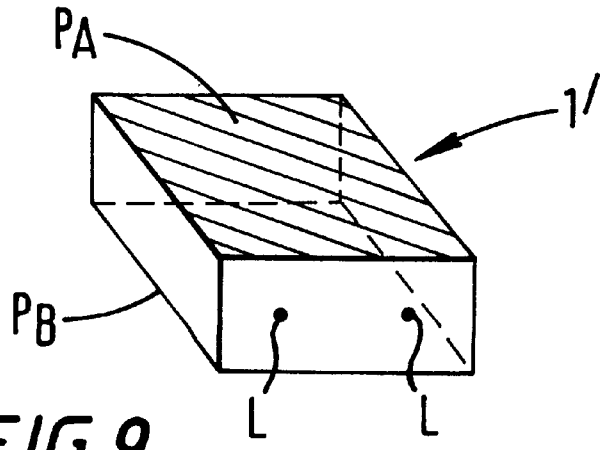
FIG. 9 is a schematic perspective view of the run time recorder shown in FIG. 8.
Figure 10:
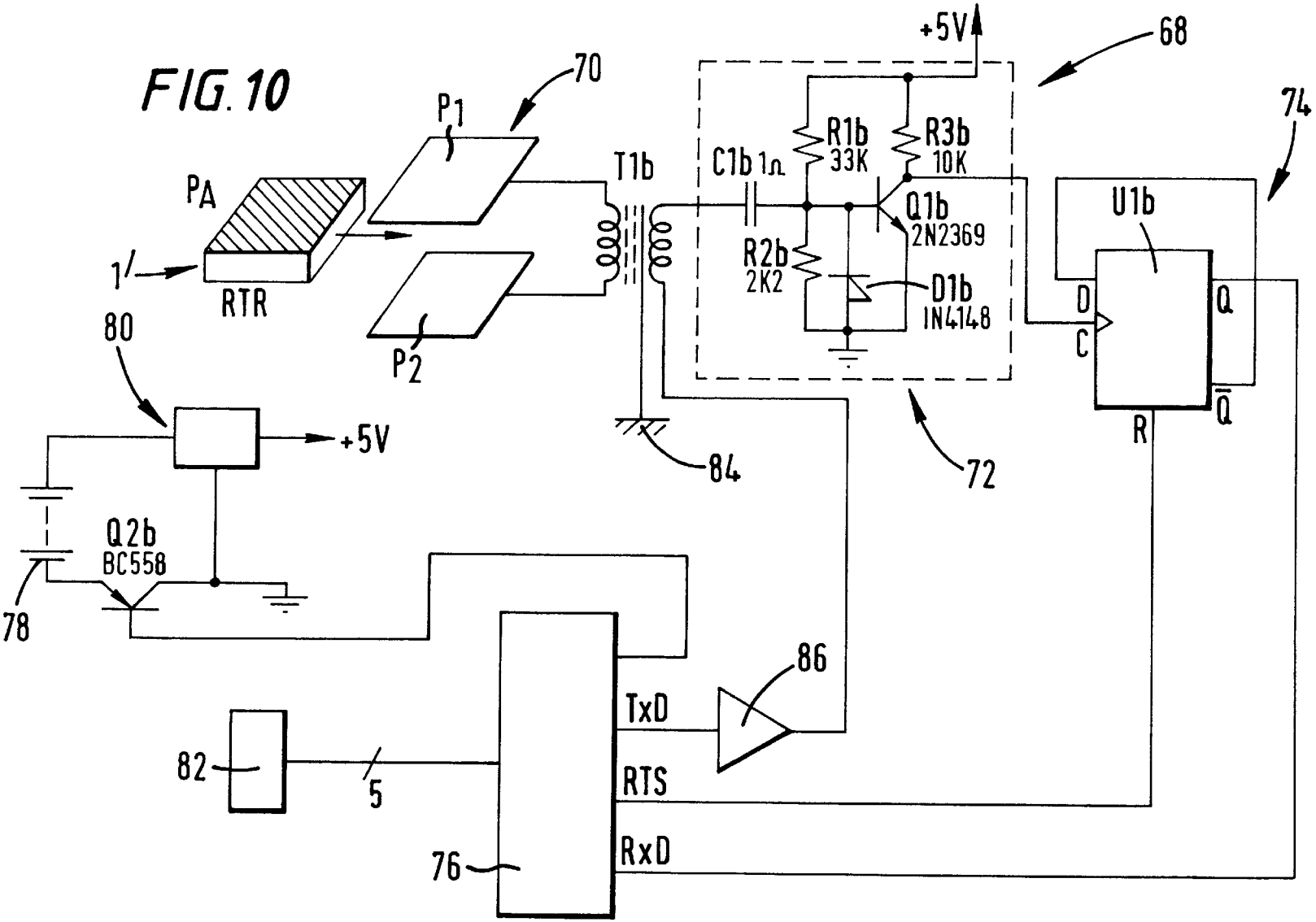
FIG. 10 is a schematic circuit diagram of a second embodiment of a reader/programmer according to the invention for use with the RTR shown in FIGS. 8 and 9.
Figure 11:
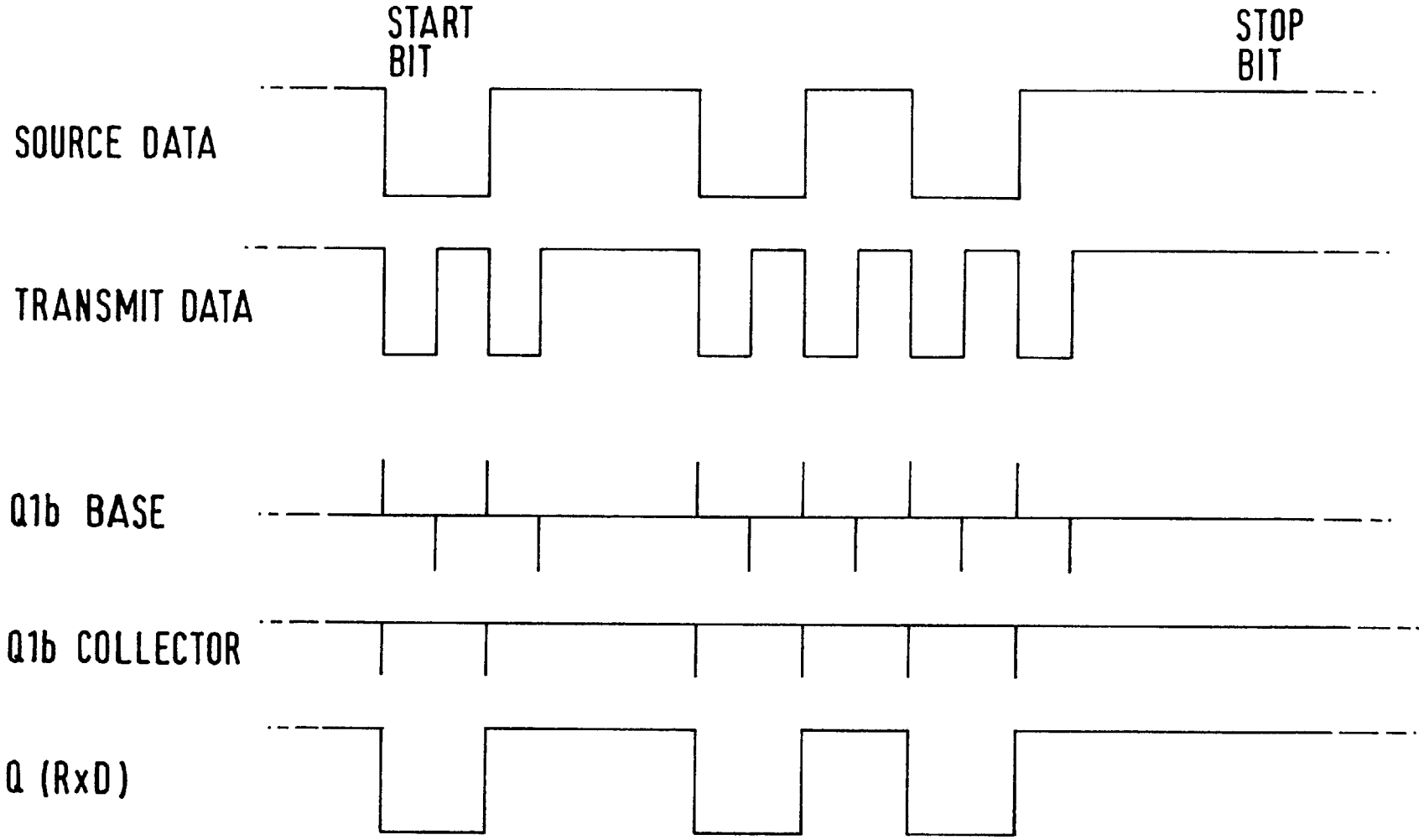
FIG. 11 is a pulse sequence diagram showing the transmission of data from a RTR to the reader/programmer shown in FIG. 10.

A reader device 68 is shown in FIG. 10 which comprises a coupling device 70 comprising a pair of pick-up plates P1 and P2 which can be arranged in a housing which is adapted to be positioned around a run time recorder such as RTR 1' to allow capacitive coupling between plates P1 and PA for example, and plates P2 and PB. The stored data in the RTR can be Output as a serial data stream to the antenna plates PA and PB as shown in FIG. 8. The data is preferably in asynchronous format for ease of ultimate interfacing with a microcomputer, such as a PC for example, and the data is transmitted in bi-phase format to allow capacitive coupling. The coupling plates P1 and P2 of reader 68 are connected to a high frequency transformer T1*b* which passes on the differential mode RTR transmissions to a transistor amplifier 72. Beneficially, the transformer does not pass on common mode mains noise and interference. The transformer T1*b* can also contain an electrostatic screen 84 to improve noise rejection. The transmitted data can be in a format of one start bit, eight data bits and one stop bit. This data can be converted to bi-phase format with one pulse for each transmission as shown in FIG. 11 as the transmit data. This data passes by the capacitive plates and transformer T1*b* to the base of transistor Q1*b*, which might be a 2N2369 device. At the base of Q1*b*, the data appears as positively and negatively differentiated pulses as shown in FIG. 11. Transistor Q1*b* can be biased just below conduction so that positive input pulses appear as negative pulses at the collector clocking the divide-by-two circuit U1*b* shown in FIG. 10. The divider converts the data back to the format of the original data which is read via output Q to interface device 76 which might be a MAX232 device for example. The divide-by-two device 74 can be reset at the end of transmission by the data processing system thereby to resynchronize the system to ensure the correct polarity of the received data. Also, reader device 68 can be used to send data to an RTR via the transformer T1*b* and coupling device 70. This can be achieved through a transmit data line path TXD through a transmitter buffer to transformer T1*b* as shown in FIG. 10. The transmit buffer 86 output can be set high or low, whichever is convenient, so that it forms a low impedance return to ground for the transformer secondary coil, allowing the signals received by transformer T1*b* to pass to the amplifier 72 unhindered. In the transmit data mode, the TXD output from device 76 is pulsed in bi-phase format already described in relation to the read mode. Diode D1*b* (for example a 1N4148 device) and the base emitter of transistor Q1*b* form a low impedance path to ground for the other end of the secondary transformer winding. Of course, in order to receive such data transmitted by device 68 the RTR, e.g. 1', would need to be equipped with an amplifier and divider such as described in relation to reader/programmer device 68. Of course, the divider could be omitted if the RTR microcomputer has a suitable pulse processing system.

The reader programmer device 68 can comprise its own DC voltage source 78 such as a series of batteries providing a 9 V output to a regulator 80 such as a 78LO5 device which provides a regulated 5 V Output useable by the various electronic components within the reader. The supply voltage can be turned on using a power switch similar to that described in relation to the reader 40 shown in FIG. 4 wherein transistor Q2*b* (such as a BC558 device) can be controlled by a microcomputer connected to interface device 76 via an input port 82 such as an RS232 serial port.

Figure 12:
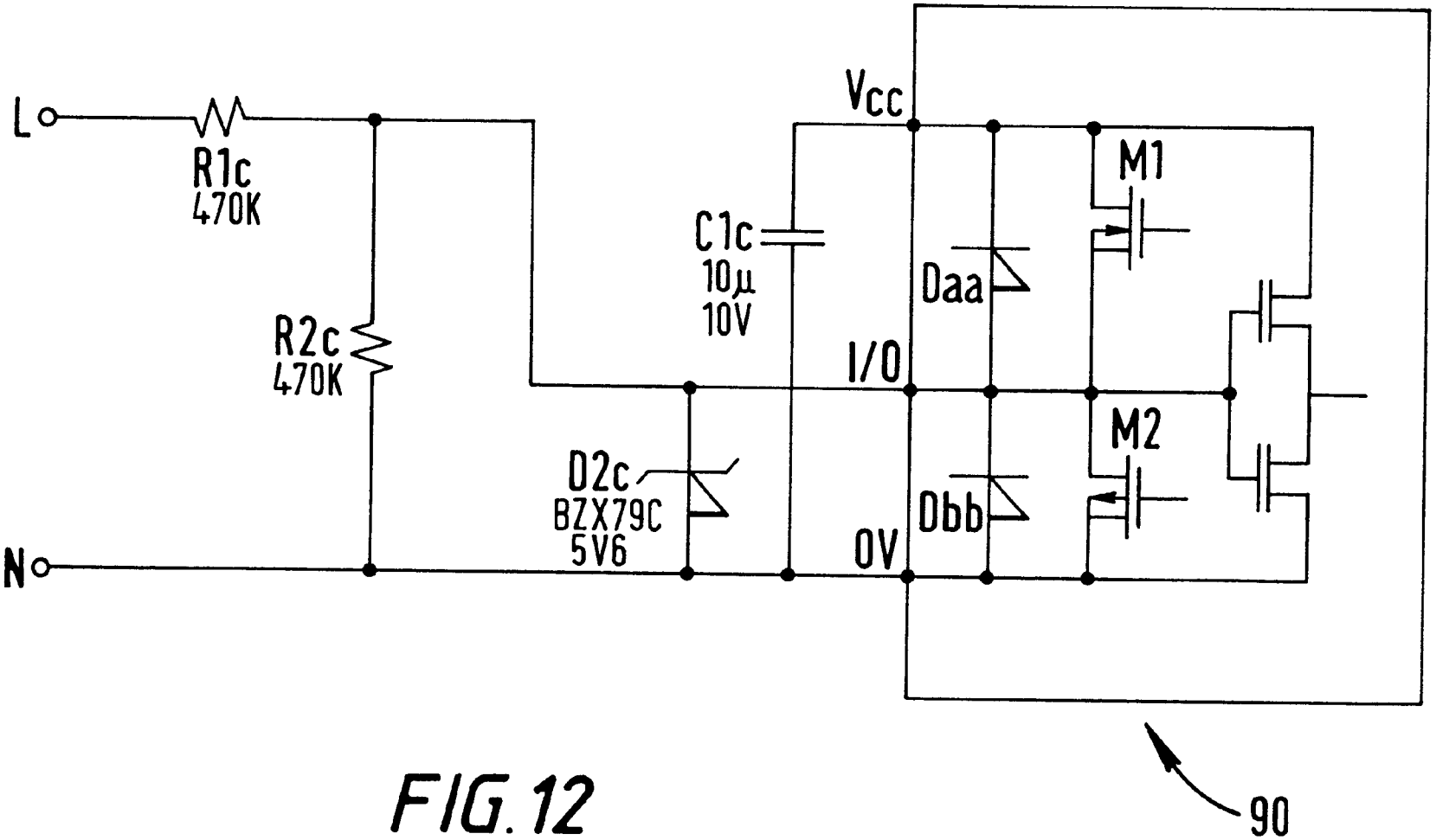
FIG. 12 is a schematic circuit diagram of an input circuit for driving a microcomputer such as contained in a RTR according to another aspect of the invention.

FIG. 1 shows a circuit for a RTR using a discrete component arrangement for the power supply and I/O circuits, however, in order to minimise size and cost it is desirable to use components inherent in the construction of the microcomputer to perform the required functions. In the modified design of FIG. 12, use is made of diodes Daa and Dbb to perform the functions of Dl and D2 in FIG. 1. Daa and Dbb are diodes which are formed by the inherent Drain-Substrate junctions of FETS M1 and M2 and/or by electrostatic discharge input protection diodes.

Of course, the effects of parasitic transistors within the structures has to be taken into account. When one of the internal diodes is forward biassed it can act as the base-emitter junction of a transistor and inject carriers into the bulk silicon, these carriers may then be collected by any nearby diffusion, thereby causing leakage currents. These currents may either be collected by diffusions connected to the power supply connections, in which case the current consumption increases, or they can be connected to internal nodes, where they may upset logic levels and cause malfunctions. However, it has been found that a suitable processor is one within the Microchip PIC16Cxx family, such as the PIC16C54 device shown as microcomputer 90 in FIG. 12.

Additionally, two strategies have been devised to avoid leakage of power supply which is a serious problem since it can result in all the input current being lost. The strategies are:

i) Operate the diodes at low forward current as the alpha (collector current/emitter current) drops rapidly as the current drops. Our tests on a PIC have showed an alpha of 0.5 at 1 mA and 0.05 at 80 microA input. At alpha equals 0.5, half the input current is lost on positive half cycles, whilst negative half cycles, what was gained is sucked out again. The desired power supply current is in the order of 0.5 mA which is in the danger region. By connecting a number of I/O pins in parallel the current per pin can be reduced to acceptable levels. In practice 4 or 5 have been found to be sufficient. In the RTR application spare I/O pins are plentiful.

ii) Connecting adjacent I/O pins to appropriate voltages. Adjacent pins are one of the major collectors of injected carriers since they are in close proximity. When adopting the strategy of 1) above a double gain can be achieved, once because of the lower current per pin, and again because there is a reduced number of close destinations for the carriers and carriers only travel a short distance before they recombine.

By connecting, for example four adjacent pins as a block, the lost current can be minimised. By connecting their immediate neighbours to 0 V the suck out of current on negative half cycles is largely eliminated.

The isolating resistor on the input, R6 of FIG. 1, is no longer required as any of the I/O pins will serve as an input. Q3 and R7 are also not needed provided the output is operated as an open drain circuit with Ml permanently off, again any or all of the I/O pins may be used as the output.

Figure 13:
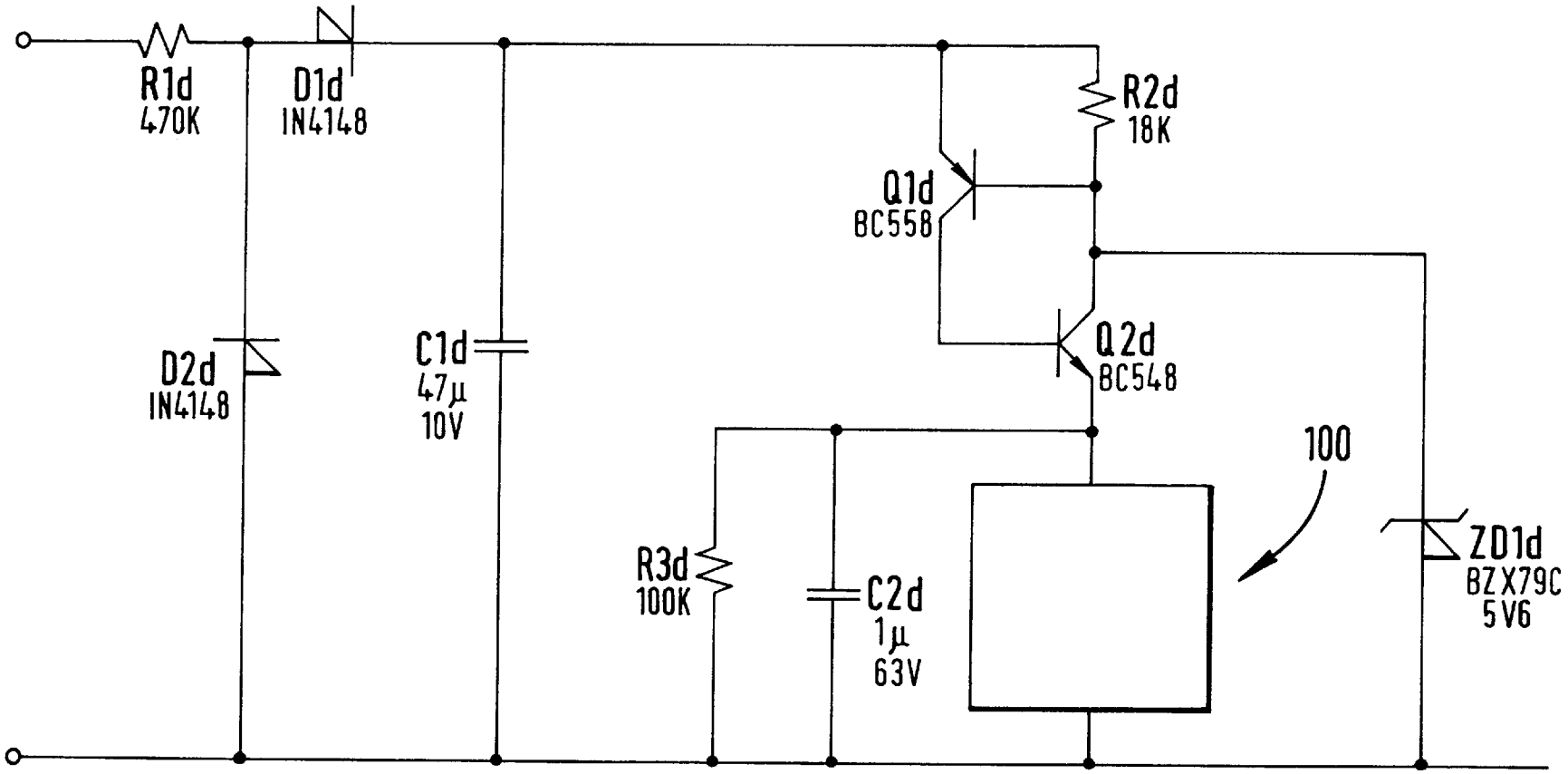
FIG. 13 is a schematic circuit diagram of a power supply circuit for driving a microcomputer according to a further aspect of the invention.

Referring to FIG. 13 there is shown a circuit to drive a microcomputer 100 which: snaps on at a well defined voltage close to the normal operating voltage of the microcomputer, and a separate power-on reset circuit is not required; has a large transient current capability to handle start-up current surges; has a large energy storage capacity to allow plenty of time for housekeeping and data storage at power loss; has a well defined snap off characteristic; and transistors Q1*d* and Q2*d* which form a regenerative switch which is off at the instant of power up. Capacitor C1*d* can be a relatively large capacitor which provides the transient start-up current and power down energy.

As the voltage across C1*d* rises, zener diode ZD1*d* eventually begins to conduct. When the voltage developed across R2*d* is sufficient, Q1*d* starts to conduct, causing Q2 to conduct and this then causes regenerative switching applying power to the microcomputer. The power supply voltage is limited ultimately by the zener absorbing excess input current. Capacitor C2*d* which is optional, provides local decoupling for the microcomputer 100 and also assists in the regenerative action by providing a transient load current spike as the voltage rises.

At switch off, the voltage across capacitor C1*d* decays and eventually the voltage across ZD1*d* drops below its conduction voltage, but the microcomputer load current provides the holding current for Q1*d* and Q2*d*. When the microcomputer load current drops below the holding current of the regenerative latch Q1*d* and Q2*d* (as set by R2*d*), it turns off and the microcomputer supply drops quickly to zero. Resistor R3*d* provides an additional load current which may be used to adjust the switch off point. The microcomputer can be put into sleep mode after power down routines have been completed, thus dropping the current consumption and switching off the supply. However if the input supply had reappeared in the meantime, the supply would not switch off and the microcomputer can be wakened by an input interrupt or watchdog timeout to continue operations.

Figure 14:
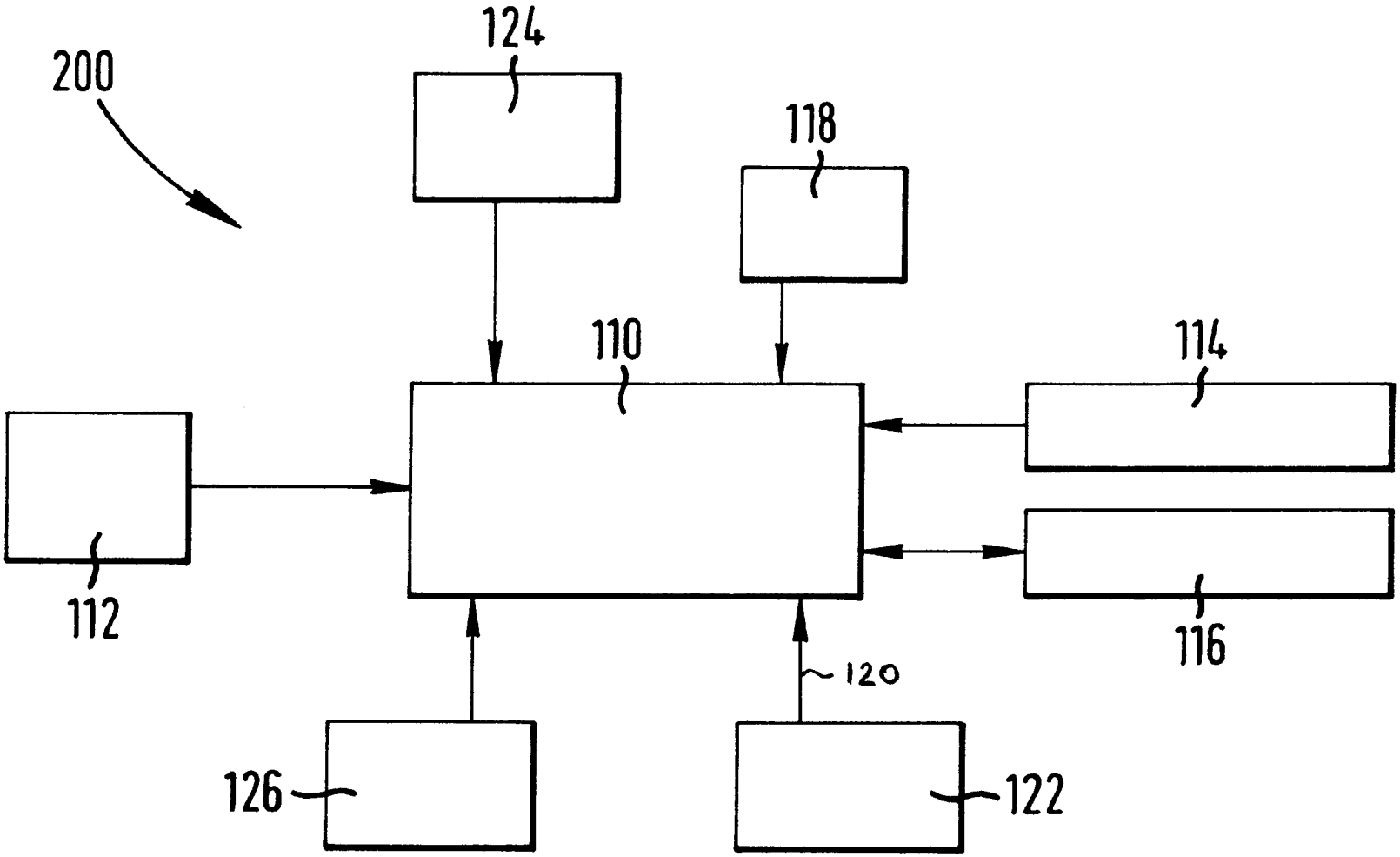
FIG. 14 is a schematic block diagram of a regulating device system according to the invention.

Referring to FIG. 14 there is shown a schematic block diagram of a regulation device 200 interfaced with a remote device or apparatus 122. A controller 110 operably communicates with various components within the device 200 including means 114 for inputting an operational data set such as an operating programme which is used by controller 110 to regulate remote device 122 via an interface 120. Device 200 stores the operating instructions in a volatile memory 116 which might of course be a set of RAM registers within a microcontroller or microprocessor device. The controller 110 can communicate with various means for monitoring operating conditions such as time via a clock 124 or temperature via a sensor 118 which might comprise some form of thermo couple or other temperature monitoring devices such as a sensor circuit containing a thermistor. Of course, the sensor might be sensitive to other conditions such as the weight of apparatus, speed of movement or flow rate of a system or energy storage such as electrical charge.

Controller 110 compares the signal or information provided by such monitoring devices, clock 124 and/or sensor 118 for example, with programmed or pre-set conditions having been input via said operation input 114 to said volatile memory 116. In the event that the controller determines from said instructional data that the monitored condition is such that a change of operating state of the remote device 122 is required, the controller effects a requisite signal via interface 120 to change the operating state of remote device 122. Of course, the input means 114 might be used to input principal instruction data, or operating program, to volatile memory 116 thereby to run controller 110 and to input secondary instructional data to complement said principal instruction data. For example, the secondary instructional data might be a new set of parameters on which to regulate the remote device 122 such as sets of times for timing device on and off. Preferably the input 114 comprises a detector which can receive input signals from a transmitter which transmitter might be portable enabling a user to use a single transmitter to adjust and/or programme many regulator devices 200.

Conveniently, a user interface 126 can be provided which enables a user to ascertain the status of device 200 and/or possibly override its current command to the remote device 122. A power source 112 is provided operably to drive the various components within device 200 and possibly remote device 122 also. For example, power source 112 might be a mains supply of AC power such as 240 V at 50 Hz as in the UK. Device 200 might comprise a rectifier and regulator in order to present a required DC voltage at the various components within the device. Additionally, device 200 might comprise a back-up power source to enable the operating data or programme stored in volatile memory 116 to be maintained in the absence of mains power for example. Said back-up power source might be a rechargeable capacitor which gradually decays during said back-up operation.

Figure 15A:
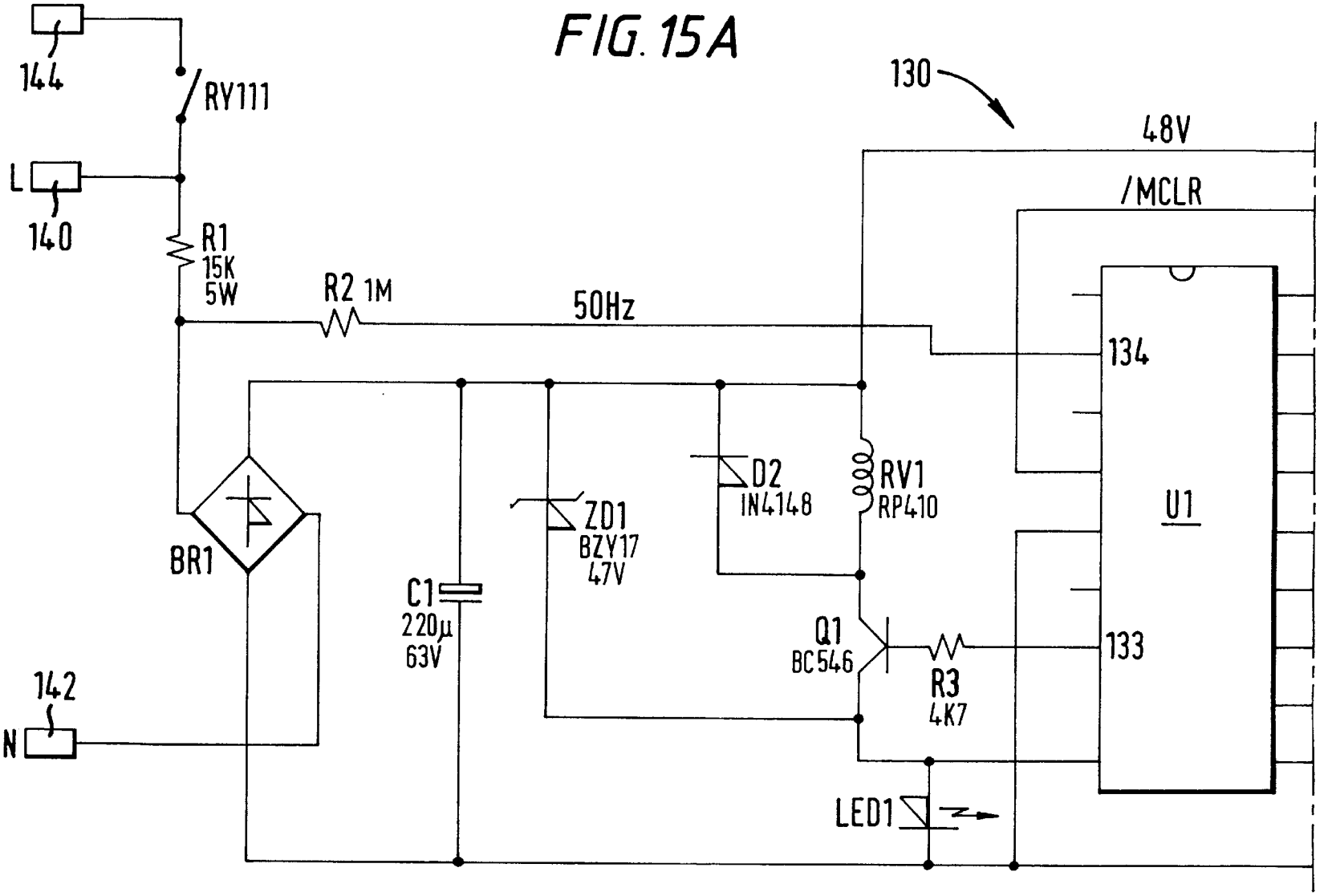
FIGS. 15A and 15B together provide a schematic circuit diagram of a preferred embodiment of the block diagram of FIG. 14.
Figure 15B:
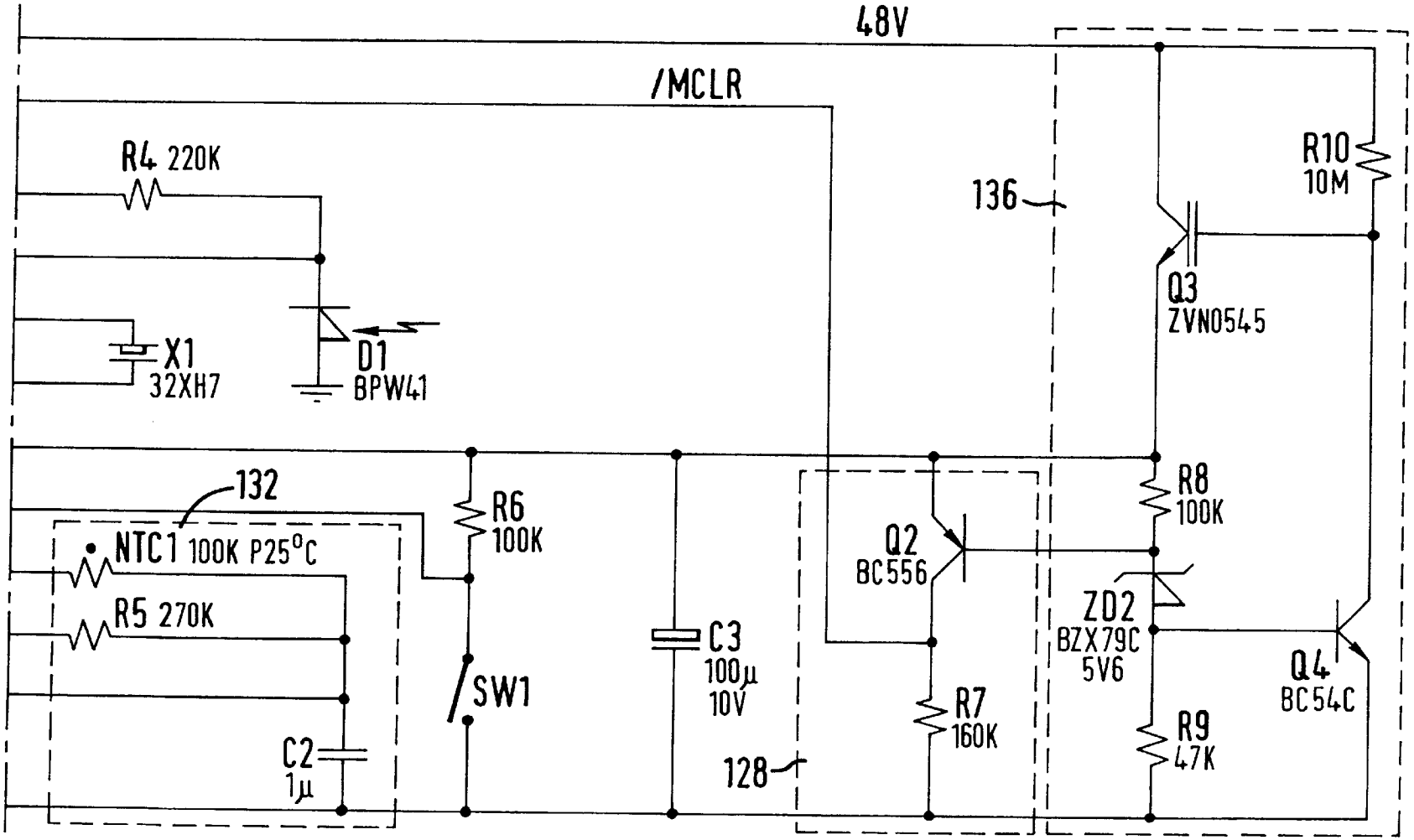

Referring to FIG. 15 there is shown a circuit for a regulating device 130 which is connectable to mains electricity at terminals 140 and 142, device 130 being operable to regulate the supply of power to a load 144 by means of a relay RY1/1. For example, load 144 might be an electrically powered radiator or other heat source wherein regulating device 130 controls the power to load 144 thereby regulating the amount of energy given off by such a radiator and thereby regulating the ambient temperature in the vicinity of the radiator. To control said ambient temperature, regulating device 130 can comprise a temperature sensor 132 which in this example uses a thermistor NTC1.

In more details, regulating device 130 comprises a microcomputer U1 such as a PIC16C54 for example, which can be programmed via an infra-red receiver such as diode D1 which might be a BPW41 device for example. A user might use a selection of predetermined programmes for operating device 130 wherein the user, who might be a specialist engineer rather than a day-to-day user of load 144, can select a requisite programme and input this into the microcomputer U1 via the receiver. Microcomputer U1 can store the programme in volatile memory registers which require the presence of power in order to retain the programme or instructions data set.

Microcomputer U1 is powered in this example from a mains supply at terminals 140 and 142. The AC supply is rectified at bridge rectifier BR1 to provide a 48 V output which is stepped-down by voltage regulator 136 to provide a 5 V source for microcomputer U1. The 48 V output is regulated by zener diode ZD1 which be a BZY9747 V device. This relatively high voltage can be used to operate power relay RY1 which might be an RP410 device and switch contacts RY1/1. Of course, the position of the relay (on or oft) is controlled by microcomputer U1 via output 133 thereof which controls transistor Q1 which might be a BC546B device for example.

Voltage regulator 136 comprises transistors Q3 and Q4 which might be a ZVN0545 and BC548 device respectively, and a zener diode ZD2 which might be a BZX79C5 V6 device for example. These provide a low consumption series regulator generating about 5 V for the microcomputer. Transistor Q2, such as a BC558 device generates a reset signal when the supply voltage falls just below the nominal regulation voltage. Resistor R8, e.g. 100 kOhm, is preferably approximately twice the value of resistor R9, e.g. 47 kOhm, such that transistor Q2 still conducts when Q4 has just ceased to conduct. Thus, MCLR is guaranteed to be high as long as the regulator operates but will go low shortly after the regulator drops out.

Microcomputer U1 monitors the presence of mains 50 Hz electricity at pin 134. In the absence of a 50 Hz signal the microcomputer preferably shuts down the various components in order to minimise power consumption; for example, the relay, and/or A/D convertor, and/or IR receiver can be turned off whilst the microcomputer continues to operate on the power stored by capacitor C1, which might for example be a 220 microF (63 V) capacitor. In the absence of mains power therefore, reservoir capacitor C1 gradually dissipates its charge maintaining power to microcontroller U1 but preferably this should take a relatively long time in order to retain the programme in microcontroller U1 until mains electricity is reestablished. By way of example only, the current drain of the microprocessor might be in the order of 50 microA and thus the leakage of power from 48 V to below the requisite 5 V before reset, might take some three minutes. Of course, if power is restored before reset occurs by device 130, operation will continue and for example relay RY1 might be reset to a closed state thereby to provide power to load 144.

The temperature sensor 132 comprises thermistor NTC1 which can thus provide a measure of the ambient room temperature. The resistance of the thermistor and hence temperature, is determined by measuring the time taken to charge capacitor C2 (e.g. 1 microF) and comparing this with the charge time for reference resistor R5, (e.g. 270 kOhm).

A crystal X1 is provided in order to generate a timing reference for the internal clock of the microprocessor U1. For example, the crystal might be a 32 kHz oscillator. The microprocessor might therefore monitor real time and for example by inputting a reference signal via infra-red receiver D1 the microcomputer might be synchronised to a standard time such as Greenwich Mean Time.

Referring again to the infra-red receiver, diode D1 is connected to microcomputer U1 by a series load R4 (e.g. 220 kOhms). Preferably, the diode is protected from ambient light by a light tight arrangement or housing such as an opaque screen. Thus, it is possible to couple a transmitter or programming device with the detector using a relatively strong infra-red signal which can pass through the screen which might be opaque to visible light. Resistor R4 is connected to one of the microcomputer outputs so that it can be disconnected from the power supply during mains interruption thereby to reduce the power drain.

A user interface can be provided such as SW1 which might for example be a boost push button which allows a user to select a change of state in the operation of load 144. For example, in this circuit, the user might be able to select a short period of heating such as one hour at 20° C. outside the pre-programmed operating period for load 144. Thus, whilst the microcomputer might be programmed to regulate a radiator 144 during office hours from say 8 am to 5.30 pm to maintain a temperature of 20° C., the user might select to override the system if working out of such office hours.

Additionally, it is possible to provide a default programme to control a regulator which programme comes into use in the absence of a programme in the volatile memory—for example after a prolonged power interruption or when the memory has not been programmed. For example, the default programme could maintain a constant low temperature of a heater to prevent freezing. The default programme could be stored in a non-volatile memory.

Also LED 1 can be controlled, for example, such that when it is constantly on this indicates that the controlled device is activated, when it flashes slowly this indicates a loss of the programme input by the user—and possibly use of a default programme therefore, whilst when a new programme is received via the IR receiver this can be confirmed by a rapid burst of flashes for example.

What is claimed is:

1. A recorder device for monitoring the operating time of an electrical appliance driven by an input voltage, the recorder device being operable in a plurality of operating modes while in a powered-on state, the recorder device comprising:

means for receiving said input voltage;

means for generating a signal representative of the nature of said input voltage;

monitoring means responsive to the signal representative of the nature of said input voltage for operatively determining the nature of said input voltage and for generating a signal indicative thereof, and a controller responsive to said signal indicative of the nature of said input voltage for causing operation in a particular operating mode of the plurality of operating modes, the particular operating mode being based on the signal indicative of the nature of said input voltage.

2. A recorder device according to claim 1, wherein the monitoring means comprises a first monitoring means, and said recorder device further comprises means for recording the duration of the operating time of the appliance, and second monitoring means adapted to monitor a periodically repeating variable supply voltage to the appliance, said second monitoring means having:

means for determining that such a variable supply is present at the receiving means; and means for causing an appropriate signal to be sent to the controller to initiate operation of the means for recording the duration of the operating time of the appliance.

3. A recorder device according to claim 1, wherein the monitoring means further comprises:

means for determining that a DC supply is coupled to said receiving means; and means for generating and sending an appropriate signal to the controller to cause operation in an operating mode in which signals are communicated with a remote device.

4. A recorder device according to claim 1, wherein the input voltage is a periodically repeating variable supply voltage, and wherein the receiving means couples to the supply voltage and communicates a signal representative of the periodically repeating waveform of the supply voltage to the monitoring means, the monitoring means having means for operably determining at least one of:

the operating time of the appliance from the number of repetitions of said periodic wave form; and when the supply voltage is terminated due to the absence of a repeating waveform.

5. A recorder device according to claim 1, wherein the controller comprises means for causing regular storage in a volatile memory of data representative of the operating time of the appliance and wherein the monitoring means includes means for determining from the supply signal when use of the appliance is terminated whereupon the controller causes said data to be stored in a non-volatile memory.

6. A recorder device according to claim 5, wherein the controller includes means for reading, after commencement of the providing of a supply voltage to the appliance, said data in said non-volatile memory and for storing said data in a volatile memory for subsequent updating during the operating time of the appliance, wherein said data contains an indication of the number of times the appliance has been used, and wherein the controller increments said data prior to storing said data in said non-volatile memory after termination of the providing of said supply voltage to the appliance.

7. A recorder device according to claim 1, wherein said monitoring means includes means for determining that a periodically repeating supply voltage is no longer present, and wherein the monitoring means further includes means for sending an appropriate signal to be sent to the controller causing data to be stored in a non-volatile memory.

8. A recorder device according to claim 1, wherein the monitoring means comprises a micro computer.

9. A recorder device according to claim 1, wherein the controller is operable in at least a monitoring or a non-monitoring mode, wherein the controller communicates with a remote device when operating in said non-monitoring mode.

10. A recorder device according to claim 9, wherein during operation in said non-monitoring mode, the receiving means is operable to receive a modulated input voltage including a signal for communication to the controller.

11. A recorder device according to claim 1, wherein said receiving means comprises rectifying means for rectifying the variable supply voltage to provide a DC voltage.

12. A recorder device according to claim 5, wherein the nonvolatile memory includes a plurality of storage locations having respective addresses associated therewith, and the controller includes means for selecting different addresses of the plurality of storage locations within the non-volatile memory at which to store data in order to avoid possible corruption of data due to repeated use of particular storage locations.

13. A recorder device according to claim 1, wherein said recorder device is connectable to a reader device for receiving electrical power therefrom wherein the voltage of said electrical power is modulated to enable communication therebetween.

14. A recorder device according to claim 1, wherein said reader device further comprises signal determining means for distinguishing between transmitted and received signals.

15. A recorder device according to claim 14, wherein said reader device further comprises a controller, and wherein said signal determining means of said reader device is operable to identify a signal received from the recorder device and to communicate said signal to said controller of said reader device upon such identification.

16. A recorder device according to claim 13, wherein certain pulse protocols are used in said modulation.

17. A recorder device according to claim 1, said recorder device further comprising means to output a signal compatible to be read by a reader device coupled thereto wherein said reader device comprises means to transfer output power to said recorder device, and wherein the voltage of said output power is modulated to enable communication between the devices.

18. A recorder device according to claim 1, further comprising means to enable non-tactile coupling with a remote device and wherein said monitoring means and said remote device are communicable with one another via a set non-tactile coupling.

19. A recorder device according to claim 18, wherein said non-tactile coupling means comprises an antenna capable of being charged to enable capacitive coupling with said remote device.

20. A recorder device according to claim 13, for communicating with a reader device, the reader device comprising a non-tactile coupling means which is preferably a chargeable antenna capable of capacitive coupling with said monitoring means.

21. A recorder device as claimed in claim 20, where said reader device includes combined half duplex transmission and reception parts.

22. A recorder device according to claim 1, further comprising a half-wave rectifier for a microcomputer comprising an input port of the microcomputer to which operably an alternating current is applied, and wherein said half-wave rectifier comprising diodes within the microcomputer to enable half-wave rectification.

23. A recording apparatus comprising:

a power supply circuit comprising a power supply input and a power supply output;

a memory comprising a plurality of storage locations and a memory interface;

a controller comprising a sense input, controller power supply input, and a write output, said sense input coupled to receive a signal indicative of a signal received at said power supply input, said power supply controller input coupled to said power supply output, said write output coupled said memory interface, and wherein said controller is operable to change between a plurality of on-state operating modes based upon said signal received at said power supply input.

24. The recording apparatus according to claim 23, wherein said plurality of operating modes includes a write mode wherein said controller writes to said memory, a transfer mode wherein information is read from said memory by a device external to said recording apparatus, a record mode wherein the time of operation of an electronic device is recorded, and wherein said controller switches operation between said write mode, said transfer mode and said record mode based upon said signal received at said power supply input.

25. The recording apparatus according to claim 24, wherein in said record mode, said controller determines said time of operation of said electronic device by sampling an AC mains waveform and comparing said sampled AC mains waveform against an internal frequency signal.

26. The recording apparatus according to claim 23, further comprising a control output coupled with said controller and wherein said controller provides a control signal to an electronic device through said control output.

27. The recording apparatus of claim 23 further comprising a temperature sensor.

28. The recording apparatus according to claim 23, wherein said memory comprises a non-volatile memory, wherein said recording apparatus further comprises a volatile memory, and wherein said controller writes to said volatile memory during said record mode and writes from said volatile memory to said non-volatile memory in said write mode.

29. The recording apparatus according to claim 23, wherein said sense input is coupled to a signal indicative of a peak magnitude of an AC mains voltage supplied to an electronic device and said controller changes between one of said operating modes based upon a magnitude of said signal indicative of a peak magnitude of an AC mains voltage.

30. The recording apparatus according to claim 23 further comprising a chargeable antenna coupled between said sense input and a signal indicative of an operational state of an electronic device.

* * * * *